United States Patent [19]

Yang

[11] Patent Number: 4,851,804

[45] Date of Patent: Jul. 25, 1989

[54] THERMO-ACTIVATING BREAKER

[76] Inventor: Tai-Her Yang, 5-1 Taipin St., Si-Hu Town,, Dzan-Hwa, Taiwan

[21] Appl. No.: 160,018

[22] Filed: Feb. 24, 1988

[51] Int. Cl.[4] ..... H01H 61/00; H01H 63/013; H01H 71/16

[52] U.S. Cl. ..... 337/23; 337/88; 337/104

[58] Field of Search ..... 337/103, 23, 24, 22, 337/14, 15, 104, 105, 81, 85, 86, 88

[56] References Cited

U.S. PATENT DOCUMENTS

| | | | |
|---|---|---|---|
| 2,333,125 | 11/1943 | Schmidinger | 337/23 |
| 2,372,295 | 3/1945 | Rubenstein et al. | 337/23 |
| 2,527,423 | 10/1950 | Jacobsen | 337/24 |
| 2,859,305 | 11/1958 | Happe, Jr. | 337/59 |
| 3,227,920 | 1/1966 | Peek, Jr. et al. | 337/365 |

*Primary Examiner*—H. Broome

*Attorney, Agent, or Firm*—Leonard Bloom

[57] ABSTRACT

A thermally actuated switch having a bi-metal switch arm carrying a contact, a cooperating contact, a heating resistor and a holding resistor. The switch is enclosed in a sealed housing and circuit connections extend from the switch contacts, heating resistor and holding resistor to the exterior of the housing. The heating position thereby closing or opening the switch contacts, depending on whether the contacts are normally-open or normally-closed. After switch actuation, the heating resistor continues to supply heat to the switch arm to hold the arm in its actuated position. The connections from the heating and holding resistors to the exterior of the housing enable the connection of external variable resistors in circuit with the heating and holding resistors whereby the time required for the switch to actuate and the time to switch remains actuated may each be varied.

6 Claims, 3 Drawing Sheets

THERMO-ACTIVATING BREAKER

BACKGROUND OF THE INVENTION

Conventional bi-metal, thermally activated switches usually contain: (1) a bi-metal leg having self resistance to generate heat; (2) a resistor wound on the bi-metal to generate heat; (3) an additional resistor to generate heat; (4) another thermal source; all to enable the bi-metal to bend due to hot expansion or cold contraction so as to drive the bi-metal to move a contact thereon to open or close a circuit. Such switches have the following defects:

(1) After actuation, the bi-metal returns to its normal state due to the gradual dissipation of heat. Except for a mechanical linkage system, an open circuit cannot be maintained, as in a circuit breaker.

(2) With a given bi-metal material and size, there are no means for adjusting the actuating current except of adjustment of the static pressure of the bi-metal.

(3) They do not provide a lamp for indicating directly the switch status.

(4) In switches having a resistor type of thermal source, the positions and distance of the resistor and the bi-metal are unstable so that quality control is difficult.

(5) The recovery from heat is too short in time. If the switch is continuously overloaded, the switch life will decrease.

SUMMARY OF THE INVENTION

The subject invention includes the following features to improve the above defects:

(1) The switch enclosure is made of insulating material. The switch contacts are fitted with conductor legs extending outside the switch enclosure to serve as an interface for connecting wires.

(2) The interface permits the connection of series or parallel resistors whereby the switch actuating current can be adjusted.

(3) A holding resistor is provided to maintain a switch open or closed state after thermal actuation. The holding resistor can be made of material emitting light and heat to provide a lighted indication of switch status. Such material may comprise a thermal generating gas such as neon or a lamp filament.

DETAILED DESCRIPTION OF THE INVENTION

Figure 1:
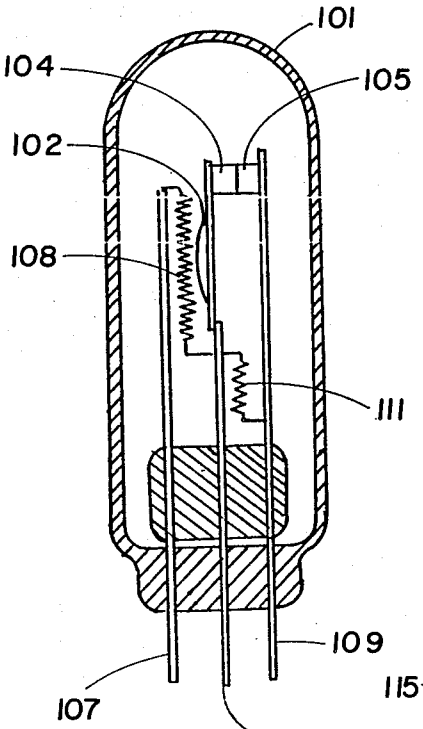
FIG. 1 is an elevation of a normally-closed type breaker including a heating resistor and a holding resistor.

Referring to FIG. 1, the invention comprises an insulating enclosure 101, suitably a glass envelope. Within the enclosure 101 is a bi-metal arm 102 having a contact 104 thereon. Arm 102 is supported within enclosure 101 by a conductive leg 103 which extends to the exterior of the enclosure. A cooperating contact 105 is held in facing relationship to contact 104 by a second conductive leg 109. Leg 109 extends externally through enclosure 101. A third conductive leg 107 extends from the exterior of enclosure 101 to the interior thereof and supports at its upper end a heating resistor 108. Heating resistor 108 is electrically connected between legs 107 and 103 in position to supply heat to bi-metal arm 102. A holding resistor 111 is electrically connected between legs 103 and 109 and is supported thereby in position to supply heat to arm 104.

Figure 2:
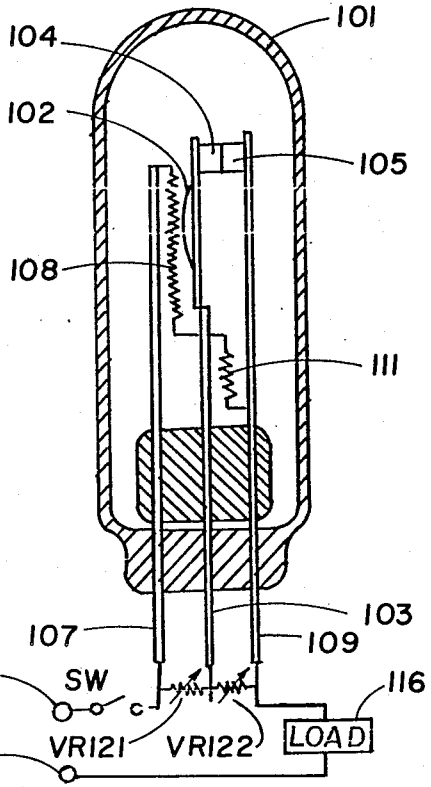
FIG. 2 is an elevation of the switch of FIG. 1 including variable resistors for adjusting the currents through the heating resistor and the holding resistor thereof.

FIG. 2 shows the circuit connections to the switch of FIG. 1 whereby the switch actuating point and hold off time may be adjusted. One line 115 of a power source is connected through switch SW to leg 107. A first variable resistor VR 121 is connected between legs 107 and 103. A second variable resistor VR 122 is connected between legs 103 and 109. Leg 109 is connected to the input of a load 116 which is returned to the power source through line 117.

When switch SW is closed, current will flow from line 115 through resistors 108 and VR 121 and contacts 104 and 105 into the load. Resistors 111 and VR 122 are at that time short circuited by contacts 104 and 105 and resistor 111 supplies no heat to arm 102. Depending on the adjustment of resistor VR 121 more or less of the load current can be made to flow through heating resistor 108, thereby permitting adjustment of the amount of heat supplied to arm 102 and consequent adjustment of load current necessary to cause the breaker switch to open. When contacts 104 and 105 open, current will flow through heating resistor 111 and variable resistor VR 122 into the load. Depending upon the adjustment of resistor VR 122, more or less current can be made to flow through resistor 111, thereby permitting adjustment of the amount of heat supplied by resistor 111 to arm 102 and consequent adjustment of the hold open time of the breaker switch.

Resistor 111 may take the form of a lamp filament which will become illuminated upon the opening of contacts 104 and 105 and provide a visual indication of the open status of the breaker switch.

Figure 3:
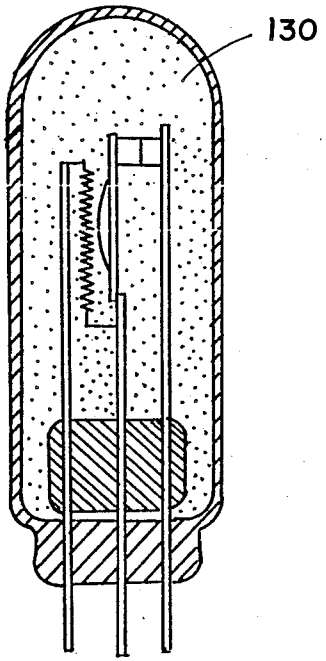
FIG. 3 is a view similar to FIG. 1 in which the holding resistor is replaced by a conductive gas.

FIG. 3 shows a modification of the switch of FIGS. 1 and 2 in which the enclosure 101 is filled with a conductive, heat producing gas or vapor 130. The gas 130 serves in place of the holding resistor 111 and may suitably comprise neon. So long as contacts 104 and 105 are closed, no energizing potential is applied to the gas 130. When these contacts open, a potential is applied to the gas. The gas then becomes excited, generating heat to hold the contacts open and light to indicate the status of the switch.

Figure 4:
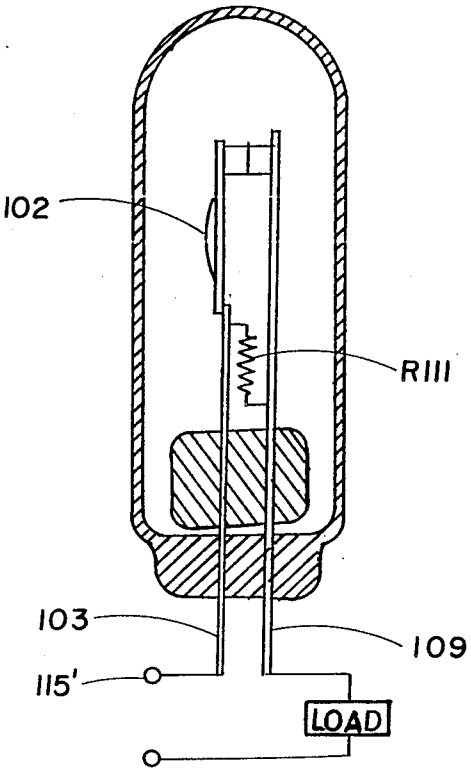
FIG. 4 is an elevation of a normally-closed type breaker in which the bi-metal switch arm serves as the heating resistor and which includes a holding resistor.

FIG. 4 shows a further modification of the switch of FIG. 1 in which leg 107 and heating resistor 108 are eliminated. Line 115' from the power source is connected directly to leg 103. In this embodiment the self resistance of the bi-metal arm 102 provides heating. Holding resistor R111 serves the same function as resistor 111, FIG. 1.

Figure 6:
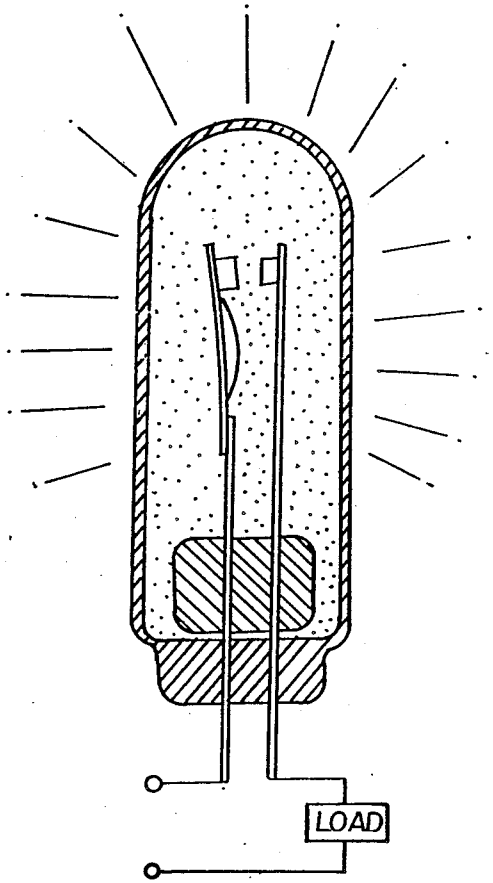
FIG. 6 is a view similar to FIG. 5 showing the illuminating action thereof on switch cut-off.
Figure 5:
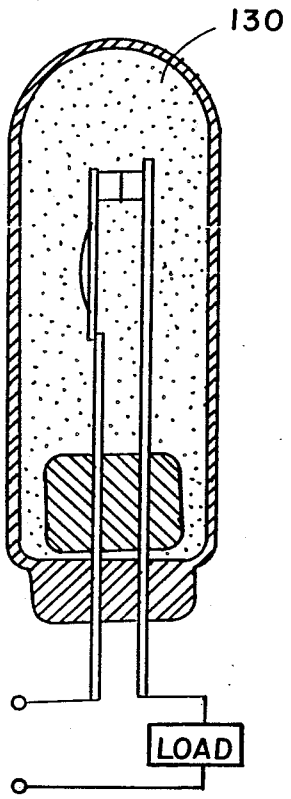
FIG. 5 is an elevation of a switch similar to that of FIG. 4 in which the holding resistor is replaced by a heat and light emitting gas.

FIG. 5 shows a modification of the switch of FIG. 4 in which the holding resistor R111 is replaced by a conductive, heat producing gas or vapor 130. FIG. 6 shows the switch of FIG. 5 when the switch contacts open and the gas becomes excited, producing illumination.

Figure 7:
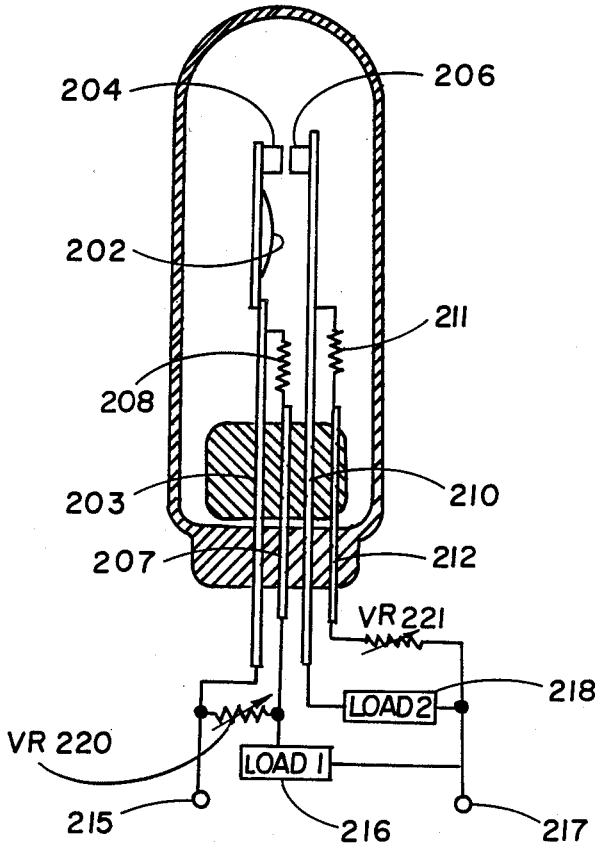
FIG. 7 is an elevation of a modification of the switch of FIG. 1 in which the switch contacts are normally open and which may be used to control a second load.

FIG. 7 shows still another modification of the switch of FIG. 1 in which the switch contacts are normally open. After thermal actuation of the switch, the switch contacts close to connect a second load to the power source. Conductive leads 203, 207, 210 and 212 extend from the exterior to the interior of the switch enclosure. Within the enclosure, a bi-metal arm 202 is affixed to the upper end of lead 203. Arm 202 carries a contact 204 at its upper end and is oriented to bend toward a second contact 206, mounted at the upper end of lead 207, upon heating. A heating resistor 208 is connected across legs 203 and 207. A holding resistor 211, which may comprise a lamp filament, is connected across leads 210 and 212.

Externally of the switch enclosure, lead 203 is connected to one line 215 of a power source. One terminal of a main load 216 is connected to lead 207 and the other terminal of load 216 is connected to a second line 217 of the power source. A variable resistor VR 220 is connected between leads 203 and 207. One terminal of a second load 218 is connected to lead 210 and the other terminal thereof is connected to power source line 217. A second variable resistor VR 221 is connected in series between lead 212 and power source line 217.

In operation, the main load 216 receives power at all times. Depending upon the adjustment of resistor VR 220, the switch can be set to actuate after operation of load 216 for a particular time at a particular load current or to actuate if the current of load 216 reaches a particular value. When the switch is actuated, contacts 204 and 206 close to supply current to load 218 and resistor 211. The current drawn by resistor 211 is adjustable by variation of resistor VR 211.

Other modification and variations in the invention are possible. For example, an electronic device such as a silicon controlled rectifier (SCR) may be substituted for the variable resistors VR 121–122 or VR 220–221 for purposes of remote or automatic control.

I claim:

1. A thermally actuated switch for controlling an electrical load, comprising:

a sealed enclosure;

first, second and third conductive leads extending from the exterior of said enclosure to the interior thereof, said first and third leads being of greater length within said enclosure than said second lead;

a bi-metal arm affixed at one end thereof to the end of said second lead within said enclosure, said arm extending parallel to said third lead and terminating substantially at the same height within said enclosure as said third lead;

a first contact mounted on said arm at the end thereof opposite said one end thereof in facing relationship to said third lead;

a second contact mounted on the end of said third lead within said enclosure in facing relationship to said second contact;

the bi-metal of said arm being so arranged that said first and second contacts are held in engagement at normal ambient temperature and that said bi-metal moves to disengage said contacts in response to elevation of the temperature above normal ambient;

a heating resistor electrically connected between the end of said first lead within said enclosure and the end of said second lead within said enclosure, said heating resistor extending substantially parallel to said arm;

a holding resistor electrically connected between the end of said second lead within said enclosure and said third lead within said enclosure;

an electrical load having first and second terminals;

a two line source of electrical power;

means connecting one of said terminals of said load to said third lead externally of said enclosure;

means connecting the other of said terminals of said load to one line of said power source; and means connecting the other line of said power source to said first lead externally of said enclosure.

2. A switch as claimed in claim 11 with additionally:

a first variable resistor connected between said first and second leads externally of said enclosure; and a second variable resistor connected between said second and third leads externally of said enclosure;

said first variable resistor permitting adjustment of the amount of current required by said load to cause said arm to move said contacts out of engagement, said second variable resistor permitting adjustment of the time during which said arm will hold said contacts out of engagement.

3. A switch as claimed in claim 1 wherein said holding resistor is comprised by an electrically conductive, heat and light emitting gas.

4. A switch as claimed in claim 1 wherein said holding resistor comprises a light emitting filament of resistor material.

5. A thermally actuated switch for controlling an electrical load, comprising:

a sealed enclosure;

first, second, third and fourth conductive leads extending from the exterior of said enclosure to the interior thereof;

a bi-metal arm affixed at one end thereof to the end of said first lead within said enclosure;

a first contact mounted on said arm at the end thereof opposite said one end thereof in facing relationship to said third lead;

a second contact mounted on the end of said third lead within said enclosure in facing relationship to said first contact, said third lead extending parallel to said arm within said enclosure to substantially the same height as the end of said arm opposite said one end thereof;

the bi-metal of said arm being so arranged that said first and second contacts are held out of engagement at normal ambient temperature and that said bi-metal moves to engage said contacts in response to elevation of the temperature above normal ambient;

a heating resistor electrically connected between the end of said first lead within said enclosure and the end of said second lead within said enclosure, said heating resistor extending substantially parallel to said arm;

a holding resistor electrically connected between the end of said fourth lead within said enclosure and said third lead within said enclosure;

a first electrical load having first and second terminals;

a second electrical load having first and second terminals;

a two line source of electrical power;

means connecting one of said lines of said power source to said first lead externally of said enclosure;

means connecting said first terminal of said first load to said second lead externally of said enclosure;

means connecting said second terminal of said first load to the other line of said power source;

means connecting said first terminal of said second load to said third lead externally of said enclosure;

means connecting said second terminal of said second load to said other line of said power source; and means connecting said fourth lead to said other line of said power source externally of said enclosure.

6. A switch as claimed in claim 5, with additionally:

a variable resistor connected between said first and second leads externally of said enclosure.

* * * * *